United States Patent [19]

McWilliams et al.

[11] Patent Number: 4,792,466

[45] Date of Patent: Dec. 20, 1988

[54] METHOD OF MAKING PANELS OF MICROPOROUS THERMAL INSULATION

[75] Inventors: Joseph A. McWilliams, Droitwich; Derek E. Morgan, Malvern; James D. J. Jackson, Kidderminster, all of United Kingdom

[73] Assignee: Micropore International Limited, Droitwich, United Kingdom

[21] Appl. No.: 46,279

[22] Filed: May 5, 1987

[30] Foreign Application Priority Data

May 14, 1986 [GB] United Kingdom ..... 8611785

[51] Int. Cl.[4] ..... B29C 41/32; B32B 5/02

[52] U.S. Cl. ..... 427/177; 156/62.2; 252/62; 264/112; 427/409; 427/421; 427/429

[58] Field of Search ..... 264/112, 123, 124, 134, 264/135, 45.1; 156/62.2; 252/62; 427/177, 429, 421, 409

[56] References Cited

U.S. PATENT DOCUMENTS

| | | | |
|---|---|---|---|
| 3,615,963 | 10/1971 | Johansson | 156/62.2 |
| 3,869,334 | 3/1975 | Hughes et al. | 428/331 |
| 3,962,014 | 6/1976 | Hughes et al. | 264/112 |
| 4,121,958 | 10/1978 | Koonts | 264/45.1 |
| 4,158,073 | 6/1979 | Schneider et al. | 264/112 |
| 4,221,672 | 9/1980 | McWilliams | 428/315.5 |
| 4,365,135 | 12/1982 | McWilliams | 428/409 |
| 4,517,240 | 5/1985 | Tracton et al. | 156/62.2 |
| 4,556,593 | 12/1985 | Hughes | 428/194 |
| 4,564,547 | 1/1986 | Hughes | 428/117 |
| 4,655,861 | 4/1987 | Kiss | 156/62.2 |

OTHER PUBLICATIONS

The Condensed Chemical Dictionary, 10th Ed., 1981, p. 840.

*Primary Examiner*—Jan H. Silbaugh
*Assistant Examiner*—Mary Lynn Fertig
*Attorney, Agent, or Firm*—Browdy and Neimark

[57] ABSTRACT

A panel of microporous thermal insulation material is manufactured by applying a film of polyvinyl acetate emulsion to a non-porous substrate, such as a sheet of steel, and compacting powdery microporous thermal insulation material against the film so as to cause the consolidated insulation material to bond to the substrate and form a panel.

7 Claims, 1 Drawing Sheet

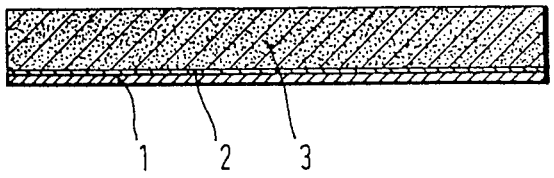
1
2
3

METHOD OF MAKING PANELS OF MICROPOROUS THERMAL INSULATION

FIELD OF THE INVENTION

The present invention relates to the manufacture of panels of microporous thermal insulation, and in particular relates to the manufacture of panels of microporous thermal insulation in which the insulation material is bonded to a substrate.

BACKGROUND OF THE INVENTION

Microporous thermal insulation materials are materials which have a lattice structure in which the average interstitial dimension is less than the mean free path of the molecules of air or other gas in which the material is arranged. This results in a heat flow which is less than that attributable to the molecular heat diffusion of air or other gas in which the material is used. The lattice structure is created within a powder material by using a powder with very fine particles in a chain-like formation which adhere to each other. A suitable powder for providing this structure is finely divided silica in the forms normally referred to as silica aerogel or pyrogenic silica, although other materials are also available. The powder may be strengthened by the addition of a reinforcing fibre such as ceramic fibre and an opacifier may be added to provide infra-red opacification.

The microporous thermal insulation material may be formed into a panel by compressing the material. However, such a panel has limited strength and is friable and readily broken. The nature of the consolidated microporous thermal insulation material makes it particularly difficult to cause the material to bond to other substrates and this results in problems in the production of robust panels of microporous thermal insulation material.

OBJECT OF THE INVENTION

It is an object of the present invention to provide a method of manufacturing panels of microporous thermal insulation which are bonded to a substrate.

SUMMARY OF THE INVENTION

According to the present invention there is provided a method of manufacturing a panel of microporous thermal insulation, which method comprises the steps of:

applying a film of a polyvinyl acetate emulsion to a non-porous substrate; and compacting powdery microporous thermal insulation material against the film so as to cause the consolidated insulation material to bond to the substrate and form a panel.

We have previously found that microporous thermal insulation materials will adhere to some substrates and not to others in an unpredictable and apparently inconsistent manner. In particular, we have found that it is especially difficult to cause the microporous materials to adhere to a substantially rigid substrate.

However, we have now found that if the substrate is coated with a film of polyvinyl acetate emulsion the microporous material will readily adhere to the substrate when compacted there against.

The substrate may be substantially rigid, for example a metallic material such as steel.

The polyvinyl acetate may be applied by brushing or spraying. The polyvinyl acetate may comprise an aqueous emulsion containing from 10 to 50 percent by weight polyvinyl acetate. The film of polyvinyl acetate may have a thickness up to about 0.5 mm. The polyvinyl acetate is preferably allowed to dry prior to compacting the powdery microporous thermal insulation material, for example for up to one hour.

BRIEF DESCRIPTION OF THE DRAWINGS

For a better understanding of the present invention and to show more clearly how it may be carried into effect reference will now be made, by way of example, to the accompanying FIGURE which is a diagrammatic illustration of a panel of microporous thermal insulation material bonded to a substrate in accordance with the present invention.

DESCRIPTION OF PREFERRED EMBODIMENT

The FIGURE shows a substrate 1 such as a sheet of steel to which a film 2 of polyvinyl acetate emulsion is applied. The emulsion may be applied by brushing or spraying and is, for example, an aqueous emulsion containing from 10 to 50 percent by weight polyvinyl acetate. Emulsions having a relatively low solids content may be applied by spraying, whereas emulsions having a relatively high solids content are generally applied by brushing. The thickness of the film applied to the substrate may be up to about 0.5 mm.

The film of polyvinyl acetate is allowed to dry. It is preferable that the film should be dry to touch, which can take up to 1 hour, but this is not essential.

The powdery microporous thermal insulation material 3 is then compacted against the film on the surface of the substrate. We have found that the insulation material remains bonded to the substrate at temperatures up to about 400° C.

We claim:

1. A method of manufacturing a panel of microporous thermal insulation material, which method comprises the steps of:

applying a film of polyvinyl acetate emulsion to a substantially rigid non-porous substrate;

allowing the polyvinyl acetate to become dry to the touch; and compacting powdery microporous thermal insulation material against the film so as to cause the insulation material to consolidate and to bond to the substrate so as to form a panel.

2. A method according to claim 1, wherein the substrate comprises a metallic material such as steel.

3. A method according to claim 1, wherein the polyvinyl acetate is applied by brushing.

4. A method according to claim 1, wherein the polyvinyl acetate is applied by spraying.

5. A method according to claim 1, wherein the polyvinyl acetate comprises an aqueous emulsion containing from 10 to 50 percent by weight polyvinyl acetate.

6. A method according to claim 1, wherein the film of polyvinyl acetate has a thickness up to about 0.5 mm.

7. A method according to claim 1, wherein the polyvinyl acetate is allowed to dry for up to one hour.

* * * * *